US006944308B2

(12) United States Patent
Gullov et al.

(10) Patent No.: US 6,944,308 B2
(45) Date of Patent: Sep. 13, 2005

(54) CAPACITIVE TRANSDUCER

(75) Inventors: Jens Ole Gullov, Lyngby (DK); Niels Eirby, Farum (DK)

(73) Assignee: Bruel & Kjaer Sound & Vibration Measurement A/S, Naerum (DK)

( * ) Notice: Subject to any disclaimer, the term of this patent is extended or adjusted under 35 U.S.C. 154(b) by 185 days.

(21) Appl. No.: 10/398,229

(22) PCT Filed: Oct. 19, 2001

(86) PCT No.: PCT/DK01/00692

§ 371 (c)(1),
(2), (4) Date: May 12, 2003

(87) PCT Pub. No.: WO02/34008

PCT Pub. Date: Apr. 25, 2002

(65) Prior Publication Data

US 2003/0174850 A1 Sep. 18, 2003

(30) Foreign Application Priority Data

Oct. 20, 2000 (DK) ..... 200001567

(51) Int. Cl.[7] ..... H04R 9/00
(52) U.S. Cl. ..... 381/174
(58) Field of Search ..... 381/369, 170, 381/173, 174, 175, 176, 177, 178, 189, 190, 191; 310/308

(56) References Cited

U.S. PATENT DOCUMENTS

| | | | | |
|---|---|---|---|---|
| 3,588,382 A | | 6/1971 | Reedyk | 381/174 |
| 3,991,285 A | | 11/1976 | Van Den Worm et al. | 381/173 |
| 4,268,725 A | | 5/1981 | Nakagawa et al. | 381/174 |
| 4,443,666 A | | 4/1984 | Cote | 381/174 |
| 4,582,961 A | | 4/1986 | Frederiksen | 381/174 |
| 5,126,614 A | * | 6/1992 | Fujita et al. | 310/323.12 |
| 5,854,846 A | | 12/1998 | Beavers | 381/174 |
| 6,169,810 B1 | | 1/2001 | van Halteren et al. | 381/174 |

FOREIGN PATENT DOCUMENTS

| | | | |
|---|---|---|---|
| DE | 43 29 993 A1 | 3/1995 | H04R/19/01 |
| DK | 146770 B | 12/1983 | H04R/19/04 |
| EP | 0 371 620 A2 | 6/1990 | H04R/19/01 |
| GB | 1 599 373 A | 9/1981 | A61B/5/08 |
| GB | 2 112 605 A | 7/1983 | H04R/19/04 |

* cited by examiner

*Primary Examiner*—Curtis Kuntz
*Assistant Examiner*—Brian Ensey
(74) *Attorney, Agent, or Firm*—Oliff & Berridge, PLC

(57) ABSTRACT

A capacitive transducer, in particular a condenser microphone, with a ring-shaped member and a diaphragm secured to the ring-shaped member. A disc-shaped member is secured in the opening of the ring-shaped member and in parallel relationship to the diaphragm. The disc-shaped member has an electrically conductive portion spaced from the ring-shaped member and facing the diaphragm in a predetermined distance therefrom, whereby the diaphragm and the electrically conductive portion on the disc-shaped member form an electrical capacitor. The second side of the disc-shaped member and the contact member are directly accessible. Also, the ring-shaped member has, outside the outer periphery of the diaphragm, a free surface extending transversally to the axis of the ring-shaped member for mounting in a microphone housing with the diaphragm flush with the front end of the microphone or slightly recessed relative to the front end.

14 Claims, 4 Drawing Sheets

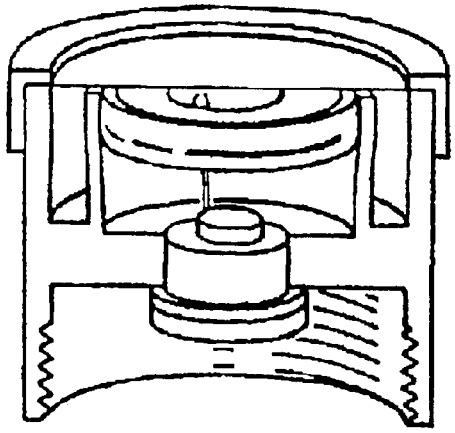
Fig. 1 - PRIOR ART
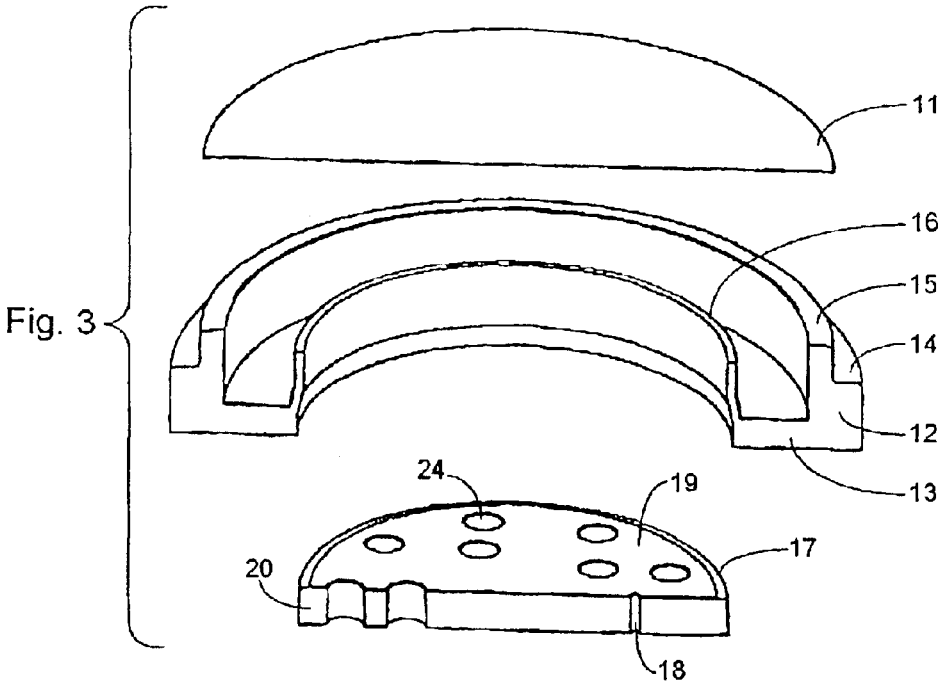
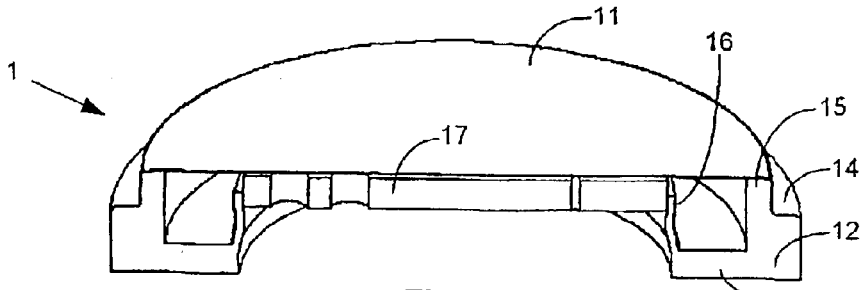
Fig. 3A

CAPACITIVE TRANSDUCER

TECHNICAL FIELD OF THE INVENTION

The invention relates to capacitive transducers, e.g. capacitive microphones of the externally polarised type or the electret type, also known as the pre-polarised type.

In particular, the invention relates to a capacitive transducer of the type with two electrically conducting plates or electrodes, one of which is movable relative to the other, which is referred to as a stationary electrode. The movable electrode is mounted on a ring-shaped member with a central opening, so that the diaphragm overlies the central opening, while the stationary electrode is in the central opening of the ring-shaped member and insulated therefrom, and the stationary electrode is kept at a small distance from the movable electrode. The invention is especially of importance in connection with condenser microphones for measurement and scientific purposes with high requirements to uniformity, linearity, stability and sensitivity to environmental variations. In the following, the terms 'condenser' and 'capacitive' are used interchangeably.

The invention relates specifically to a capacitive transducer for use in a transducer such as a condenser microphone.

DESCRIPTION OF RELATED BACKGROUND ART

A primary requirement to be met by a microphone for measurement and scientific purposes is that the acoustic performance of the microphone must be good, meaning that, in order to achieve good accuracy of the measurement, the linearity and stability of the microphone are good, and that the microphone disturbs or affects the sound field to be measured in a well controlled and predictable way. It is further necessary that the microphone have a low sensitivity to environmental variations such as temperature and static pressure. In order to obtain reproducible results and to extend the intervals between calibrations it is also imperative that the microphone exhibits good short-term and long-term stability. Furthermore it must be possible to carry out calibration in a simple manner to verify the primary characteristics of the microphone, which are its frequency response and sensitivity. Furthermore it must be possible to predict the performance of the microphone not only by means of direct measurements, but also by means of calculations based on theoretical considerations in order to give an independent confirmation of the measured signal.

Condenser microphones for scientific and measurement purposes are commonly made up of precision-machined mechanical elements. The main elements of a condenser microphone are a stationary electrode, also called a back plate electrode, and a movable electrode embodied as a diaphragm which, when at rest, is kept at a well-defined distance from the back plate electrode. The back plate electrode and the diaphragm are, and together they constitute the electrodes of a capacitor employing ordinary atmospheric air as the dielectric. The diaphragm, which in high quality transducers is made of metal, is usually mounted at an end of the microphone housing. The microphone housing, the insulator and the diaphragm form a closed compartment. The occurrence of a pressure difference between the outer atmosphere and the closed compartment causes the diaphragm to move, and this movement causes a change in capacitance, which can be measured electrically. The frequency response at higher frequencies is determined essentially by the resonance of the diaphragm and by its damping. The resonance frequency is determined by the mass of the diaphragm and by its mechanical tension. The damping depends on the mobility of the air in the space between the diaphragm and the back plate electrode, and therefore it can be varied and controlled by varying the geometry of the back plate electrode and by choosing the appropriate distance between the diaphragm and the back plate electrode. In most measurement microphones the distance between the diaphragm and the back plate electrode typically ranges from 10 $\mu$m to 30 $\mu$m. For an individual type the tolerance of the distance between the diaphragm and the back plate electrode must be controlled within ±5% in order to get a uniform damping of the diaphragm displacement in the region of interest. The damping is usually controlled by having a number of holes in the back plate electrode, which lead from the space between the diaphragm and the back plate electrode to the rear surface of the back plate electrode. The sensitivity of a condenser microphone is proportional to the distance between the electrodes and inversely proportional to the tension in the diaphragm. As the tension is dependent on the extension of the foil, the diaphragm has to be fixed to the microphone housing or ring-shaped member in a very well defined manner in order to have a good long-term stability.

GB 2 112 605 discloses a prior art condenser microphone, which is shown in FIG. 1. The prior art microphone has a cylindrical microphone housing with a transversal wall supporting an inner cylindrical wall coaxially with the microphone housing. A ring-shaped disc of an insulating material is press-fitted into the opening of the inner cylindrical wall. A coating layer of an electrically conductive material covers the central portion of the upper surface of the insulating disc and is spaced from the inner cylindrical wall. The conductive material also covers the surface in the opening in the ring-shaped disc, where a conductor is connected to the coating. The wire is connected to a terminal of the microphone, which is insulated from the housing. A conductive diaphragm is mounted over the end of the housing at a small distance from the coating on the ring-shaped disc.

The prior art microphone in FIG. 1 has some fundamental problems, which are that the entire microphone must be assembled before test and characterisation are possible, and that all parts in the microphone have a great influence on the sensitivity of the microphone to temperature, meaning that the materials and dimensions of all included parts must be selected with great care. Also the prior art microphone is costly to produce, while the invention provides a simple design, simple manufacture and lower price.

EP 371 620 discloses a typical microphone for lower cost applications. That construction has eliminated the need for a separate stationary electrode or back plate electrode by integrating the stationary electrode into the housing. While this is an elegant way of reducing the number of components in low cost microphones, it is unsuited for measurement microphones for many reasons. Among these are that in measurement microphone requirements with respect to tolerances require that the distance between the two electrodes is controlled within ±5%, which is not possible in this design; i.e. if for example the microphone is subjected to a mechanical shock resulting from being accidentally dropped onto a floor, the housing might deform, causing the distance between the diaphragm and stationary electrode to change. Also, scientific and measurement microphones must have very low sensitivity to variations in temperature, humidity and static pressure and this is difficult to achieve in this design. Also measurement microphones require that it must be possible to predict the microphone performance by means of calculations based on theoretical considerations in order to give an independent confirmation of the measured data, and this will be difficult in this design.

SUMMARY OF THE INVENTION

A problem of the above-discussed prior art is that the entire transducer must be assembled before test and characterisation is possible. A transducer, which complies with the specifications, may then have to be discarded or returned for adjustment or repair.

The object of the invention is to provide a capacitive transducer for use eg in condenser microphones, where the capacitive transducer defines the major parameters of the transducer so that possible deviations from the specifications may be detected at an early stage, ie before a complete transducer has been manufactured, whereby to obtain a more economical production.

In the present context, the term 'electrode' is taken to mean an electrically conducting member including possible means for carrying the electrode.

The two electrodes may both be movable or both be fixed or one may be fixed and the other movable.

In a preferred embodiment the first electrode is stationary and the second electrode is movable.

In a preferred embodiment the support and the electrodes when assembled form a closed compartment and the compartment contains air.

In the present context, the term 'closed compartment containing air' is taken to mean that the volume of air enclosed by the support and the electrodes may or may not be hermetically sealed.

When the support comprises a cylindrical tubular body defining an axial direction, the body having inner and outer faces and first and second axial ends, and the stationary electrode is secured to the inner face of the body at or near the first axial end, and the movable electrode is mounted along its periphery on the second axial end of the body in parallel with and at a predetermined distance from the stationary electrode, it is ensured that a flexible means for holding the electrodes of the transducer in a fixed geometrical position with respect to each other is provided.

According to the invention, there is provided a capacitive transducer with two electrically conducting plates, one e.g. a stationary electrode and the other e.g. an electrode which is movable relative to the stationary one. The movable electrode is mounted at the end of a transducer ring-shaped member, while the stationary electrode is placed on an insulating body which is secured in the interior of the ring-shaped member, and which supports the stationary electrode at a well-defined, small distance from the movable electrode. Because the ring-shaped member has both electrodes mounted thereon or therein, the ring-shaped member can be inserted into a wide variety of microphone housings without compromising the overall requirements with respect to stability and environmental sensitivity. This allows the housing to be manufactured with less severe tolerances and in cheaper materials than before. This achieves a number of advantages. The parts of the microphone can be manufactured separately within the required accuracy, avoiding the need for individual handling. Selecting materials and geometry for the parts is a less critical matter than before, because only the capacitive transducer determines sensitivity and frequency response as well as most of the environmental sensitivity. Finally, the transducer can be tested for functionality on the two primary parameters, frequency response and sensitivity, before being finally mounted in a microphone housing. This permits the detection of critical parameters being outside tolerance limits or deviations from target parameters and of faults and errors much earlier in the manufacturing process than was previously possible. This will result in considerable cost savings during production. Previously this test could only be performed when the entire microphone was assembled.

When the tubular body comprises an outer wall and a substantially cylindrical inner supporting wall member, which is rigidly connected to the outer wall near the first axial end through a transversal wall, the inner supporting wall member extending in the axial direction of the tubular body over a fraction of its axial length and constituting a seat for the stationary electrode, it is ensured that a convenient design for inserting the stationary electrode (possibly including its carrier member) into the tubular body is provided. Further, it provides a basis for ensuring that the two electrodes are kept apart at a constant and well-defined distance, which is reproducible from device to device.

When the first electrode comprises an electrically insulating carrier member carrying an electrically conducting member, it is ensured that a convenient means for performing the function of fixing the first electrode to the support is provided. Instead of being partly made of electrically insulating and partly of conducting members, the electrode may be made entirely of an electrically conducting member (e.g. a metal) or it may be made of an electrically conducting material mixed with an electrically insulating material at a microscopic or macroscopic level.

In a preferred embodiment the tubular body and the electrodes are designed as regards mechanical construction and choice of materials so that stresses, including thermally induced stresses, are minimized.

In a preferred embodiment the cylindrical tubular body of the support is made of an electrically conducting material. Instead of being made entirely of an electrically conducting material it may be made of an electrically insulating material (e.g. a ceramic material) or of an electrically insulating material coated with a metallic material or the like.

In a preferred embodiment the stationary electrode and the tubular body are adapted to allow the stationary electrode to be secured to the tubular body of the support by frictional forces between the stationary electrode and the tubular body. This has the advantage of allowing the mounting of the stationary electrode by a press fitting process without the need for other fastening means.

Alternatively, the stationary electrode is secured to the tubular body of the support by adhesive means.

In a preferred embodiment the stationary electrode takes the form of a back plate electrode comprising an electrically insulating carrier material, whose two opposing sides are fully or partially coated with an electrically conducting layer, and the layers are electrically connected and are spaced from the areas of contact between the back plate electrode and the tubular body in such a way that electrical isolation between the back plate electrode and the tubular body is ensured. This has the advantage of providing a convenient and reproducible solution that allows an easy mechanical coupling to the tubular body and an easy electrical connection of the stationary electrode to other parts and of ensuring that the stationary electrode does not connect electrically to the tubular body.

When the electrically insulating material is chosen from the group of materials comprising ceramic materials, plastics, glass, ruby, sapphire and quartz, it is ensured that a spectrum of relevant materials having a proper selection of low electrical conductivities is provided.

When the electrically conducting layer on the electrically insulating carrier material of the stationary electrode are made by a screen printing, a stencil printing or a evaporation process, it is ensured that one of a selection of standard methods, routinely used in electronic environments, is utilized providing an accurate as well as an economical solution.

When the movable electrode is made of a metal, a metal alloy or a metallized insulator, it is ensured that a membrane or diaphragm is provided that is well suited for high-quality transducers, including measurement microphones.

When a layer of an insulator serving as an electret is applied to one or both electrodes, it is ensured that the part is suitable for use in pre-polarized microphones.

The stationary electrode comprises an insulating body e.g. shaped as an insulating disc having an electrically conductive coating made by screen printing, stencil printing or evaporation techniques. The insulating body is preferably made of ceramics having the conductive coating screen printed or evaporated on one side. The stationary electrode can be coated with a thin layer of fluorinated ethylene propylene or a similar insulating material for use in pre-polarized microphones, also known as electret microphones.

When the electrically insulating carrier member is manufactured from a sheet of a ceramic material by laser cutting or laser drilling, it is ensured that an especially economical solution is provided.

When the back plate electrode is manufactured by applying a pattern of electrically conducting layers to opposing sides of a sheet of ceramics material by a screen printing, a stencil printing or a evaporation process, the pattern forming an array of individual back plate electrodes, and by separating the back plate electrode from the sheet by laser cutting or laser drilling, it is ensured that an especially economical solution is provided, which is well suited for large scale production of transducers with a high accuracy.

When the support has a reference plane in a well-defined position relative to the second electrode and the first electrode is mounted in the support relative thereto, it is ensured that a precise and reproducible mounting of the stationary electrode relative to the movable electrode is provided.

When the position of the reference plane relative to the movable electrode is defined by a screen-printing, a stencil printing or an evaporation process, it is ensured that a very precise, easily adjustable and reproducible mounting of the stationary electrode relative to the movable electrode is provided.

When a predefined distance between the electrodes in a relaxed state is defined by a screen-printed pattern on the back plate electrode, it is ensured that a very precise, easily adjustable and reproducible mounting of the stationary electrode relative to the movable electrode is provided.

A transducer comprising a housing with an assembly comprising first and second electrodes separated by a dielectric material, a back chamber with a bottom wall and electrical terminals connected to the electrodes, and means for fixing the assembly in the housing is furthermore provided by the invention. When the first and second electrodes separated by a dielectric material are provided in the form of a capacitive transducer according to the claims and the capacitive transducer is adapted for being mounted in the housing, it is ensured that a transducer that has a high quality, which may be configured to a lot of different applications, having different specifications and different physical embodiments, and is economical in production is provided.

When it is adapted for use as a condenser microphone by forming one or more openings in the first electrode, the electrode being stationary, it is ensured that a high-quality microphone that is well suited for use as a measurement microphone is provided.

The capacitive or condenser microphone consists of a ring-shaped member which has a movable electrode or diaphragm mounted on one side. Inside the ring-shaped member, a stationary electrode also known as a back plate electrode is mounted close to the diaphragm. The ring-shaped member with the diaphragm and back plate electrode forms a capacitive transducer unit, which can be mounted in a housing. The ring-shaped member with the diaphragm and back plate electrode has most of the functionality of the complete microphone, allowing testing and characterisation of the primary characteristics, sensitivity and frequency response, before the entire microphone is assembled. This means that the microphone will be simpler to make and simpler to test and it can be manufactured at a much lower cost. Also the microphone's sensitivity to environmental variations is determined to a great degree by the ring-shaped member with the diaphragm and back plate electrode, making the choice of materials for housing, internal cavity and bottom wall a less critical matter compared to prior art microphones, where each part had to be selected with care.

When the housing is shaped so that its height is reduced to a minimum determined mainly by the height of the capacitive transducer in a direction perpendicular to the electrodes, and the area of the bottom wall is larger than the area of the second electrode, it is ensured that a very flat microphone is provided.

When the bottom wall has means for pressure equalization between the back chamber and its environment, and the bottom wall comprises a body having an essentially planar surface area of contact with the back chamber, and the means for pressure equalization comprise a geometrical pattern extending from the surface of the body, and the pattern overlaps the area of contact in such a way that at least one opening between the back chamber and its environment is formed when the back wall is joined with the back chamber, it is ensured that a very reproducible and precise method of controlling the low frequency cut-off of the transducer is provided. The pattern may be generated in a number of standardized ways, e.g. by means of screen-printing and or laser cutting or drilling, making it highly advantageous from a production and economical point of view.

A transducer system comprising a housing with first and second electrodes separated by a dielectric material, a back chamber with a bottom wall and electrical terminals connected to the electrodes is moreover provided by the invention. When it comprises a capacitive transducer according to the invention and the capacitive transducer is adapted for being mounted in the housing together with amplifier and electronic interface units, it is ensured that a system that may be adapted to various specifications and physical embodiments may be economically provided.

The transducer housing can be made to allow easy integration of an electrical amplifier or other electronics without compromising the overall requirements with respect to stability, linearity and environmental sensitivity. Compared to the prior state of the art this is possible because the diaphragm and the back plate electrode are to be mounted in a ring-shaped member independently of the housing, thereby making the design of the transducer housing much less critical than before. This can be used to shape the transducer housing in such a way that the amplifier can easily be integrated into the microphone without increasing the cost of the transducer housing. With the prior art, integration of an amplifier would still have been possible, but it would have meant that a complicated body, the transducer housing, would be more complicated with a higher cost as a consequence.

The advantages of the capacitive transducer of the invention can be summarised as follows:

- The transducer can be assembled in a much simpler manner than before.
- The primary characteristics of the transducer can be characterised before final assembly in a housing, which reduces the cost.
- The capacitive transducer consisting of a ring-shaped member with a diaphragm and a back plate electrode allows manufacture of transducer housings with less demanding tolerances on dimensions and less requirements with respect to materials.
- The invention provides thinner transducer housings than before, which enables new applications where today's transducers fail to comply with requirements to size.
- Instead of complicated bodies, a transducer can be made with simple bodies, which can be manufactured separately and at much lower cost. As an example the microphone housing in the prior art was complicated and expensive to manufacture. In the invention this complex body is replaced with a simple housing and a simple back chamber, which can be manufactured at much lower cost.
- Integration of an amplifier or other electronics is possible without significantly increasing the cost of the transducer housing.

BRIEF DESCRIPTION OF THE DRAWINGS

The invention will be explained more fully below in connection with a preferred embodiment and with reference to the drawings, in which:

FIG. 1 shows a prior art condenser microphone,

FIG. 3 shows an exploded view of a cross section through a capacitive transducer according to the invention, FIG. 3A shows the capacitive transducer in FIG. 3 assembled.

Figure 2:
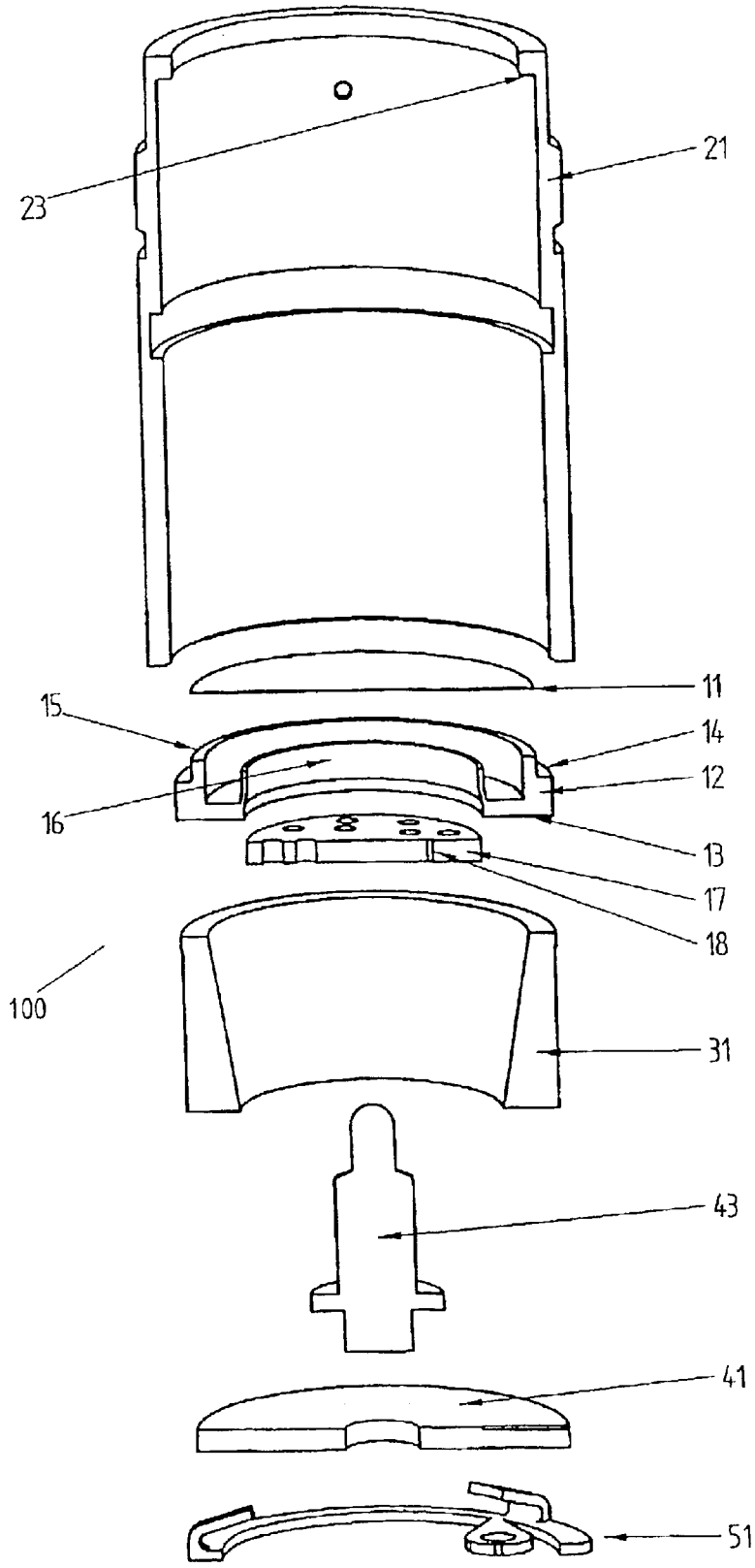
FIG. 2 shows an exploded perspective view of a condenser microphone using a capacitive transducer according to the invention.

The figures are schematic and somewhat simplified for clarity, and they just show details, which are necessary for the understanding of the invention, while inessential details are omitted. Throughout the following description, the same reference numerals are used for identical or corresponding parts.

DETAILED DESCRIPTION OF THE INVENTION

Figure 4:
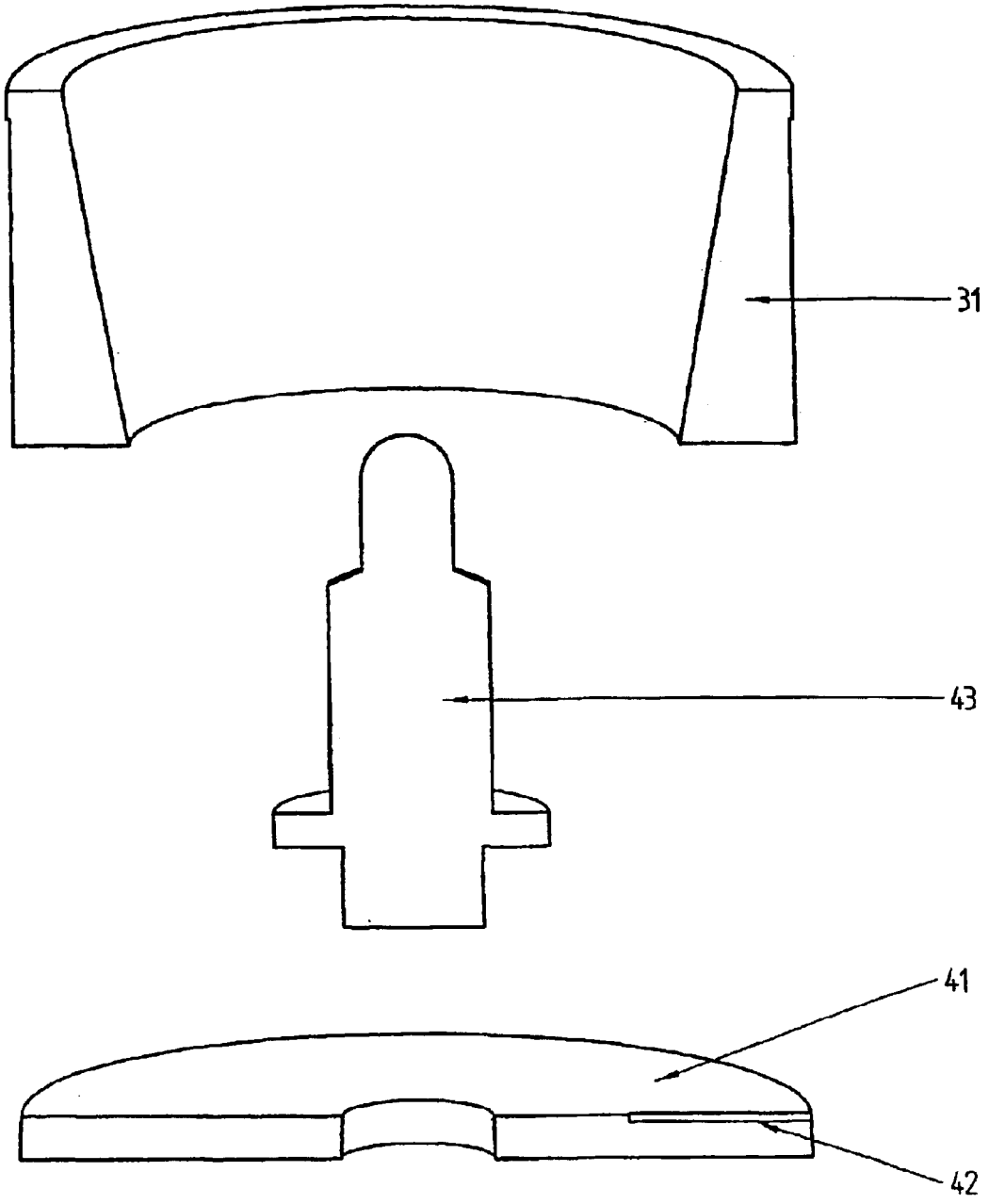
FIG. 4 shows an exploded view of the microphone bottom wall and the internal cavity piece.

FIG. 2 shows an exploded perspective view of a condenser microphone using a capacitive transducer according to the invention, and FIGS. 3, 3A and 4 show details thereof, where FIGS. 3 and 3A show the capacitive transducer used in a condenser microphone, and FIG. 4 shows an exploded view of the microphone bottom wall and the internal cavity piece of the microphone in FIG. 2.

The microphone 100 (FIG. 2) comprises a capacitive transducer 1 (FIGS. 3 and 3A). The capacitive transducer 1 comprises a ring-shaped member 12 with a bottom wall 13 and two upstanding concentric ring-shaped walls with a radial space therebetween. The outer ring-shaped wall carries a diaphragm 11. The free end of the inner ring-shaped wall is recessed below the free end 15 of the outer ring-shaped wall, and it accommodates a stationary electrode also referred to as a back plate electrode 17 therein. Together the ring-shaped member 12, the back plate electrode 17 and the diaphragm 11 constitute the capacitive transducer 1.

The ring-shaped member 12 is an electrically conducting cylindrical body made of metal. The inner ring-shaped wall 16 is so dimensioned as to allow expansion, when the back plate electrode 17 is inserted therein, so that the back plate electrode 17 is retained in its position by means of frictional forces acting between the inner surface of the supporting wall member 16 and the outer surface of the back plate electrode 17.

Outside the outer periphery of the diaphragm 11 the ring-shaped member 12 has a free surface 14 acting as a reference plane for precise mounting of the ring-shaped member 12 against a corresponding reference plane 23 inside the microphone housing 21. The reference plane 14 of the ring-shaped member 12 and the corresponding reference plane 23 inside the microphone housing are matching surfaces and are preferably plane faces, but the faces may be slightly conical, whereby the transducer of FIG. 3A will be centred in the microphone housing 21.

The ring-shaped member 12 has an upstanding outer ring-shaped wall with an end surface 15 for mounting of the diaphragm 11. The surface 15 of the ring-shaped member 12 has a rounded outer edge and also serves as a reference plane for mounting the back plate electrode 17 in the ring-shaped member 12. During mounting it is important to place the back plate electrode 17 precisely at the desired distance from the diaphragm 11. This is done by using the surface 15 as a reference plane. With proper equipment this mounting can be done with a precision of ±1 $\mu$m or better. The back plate electrode 17 is mounted in the ring-shaped member 12 by being pressed into either end of the ring-shaped wall 16, which is dimensioned so that the ring-shaped wall expands during the insertion of the back plate electrode, which is then retained therein by frictional forces, or the back plate electrode is inserted into the ring-shaped wall 16 without deforming this, and is retained therein by means of glue or other fastening means.

The back plate electrode 17 has a body 20 of an insulating material, eg a ceramic material such as $Al_2O_3$, with a conductive coating 19 (in FIG. 3) on the top side facing the diaphragm 11, and a conductive coating on the bottom side (not shown) opposite the diaphragm 11. Other insulating materials can be used for the disc-shaped body 20, such as ceramic materials, plastics, glass, ruby, sapphire and glass. The conductive coating 19 can be deposited by any suitable process such as screen printing, stencil printing or an evaporation process. The back plate electrode has through-going holes 24 for establishing damping of the movements of the diaphragm.

The coatings on the two sides of the back plate electrode are in electrical contact with each other through a vertical electrical feed-through 18 in the back plate electrode 17 or through one or more of the through-going holes 24. The coating does not reach the edge of the insulating disc, whereby a suitable insulation is established between the conductive coating 19 on the back plate electrode and the diaphragm 11 on the ring-shaped member 12. Alternatively, the back plate electrode 17 can be a metal disc with a rim of an electrically insulating material to establish insulation between the metal disc and the ring-shaped member.

The diaphragm 11 is welded, using eg a laser beam, or soldered onto the surface 15 of the ring-shaped member 12 for optimum long-term stability. Before welding, the diaphragm 11 is stretched to achieve the correct tension required for the desired sensitivity and resonance frequency etc. The back side of the back plate electrode 17, ie the side opposite the diaphragm, and in particular the conductive coating are directly accessible on the capacitive transducer shown in FIG. 3A.

As illustrated in FIG. 2, when a diaphragm 11 and a back plate electrode 17 have been mounted, the ring-shaped member 12 is inserted into a microphone housing 21, using the reference plane 14 for a precise mounting of the ring-shaped member against the reference plane 23 of the microphone housing. Following this, an internal cavity piece 31 is inserted into the microphone housing 21 with one end in contact with the end 13 of the ring-shaped member. By increasing or decreasing the inner diameter and/or the length of the housing and the internal cavity piece 31 the size of the back chamber volume in the microphone can be adjusted. Following the internal cavity piece 31, a microphone housing bottom wall 41 of an electrically insulating material is inserted, having a pressure equalization channel 42 with a well-controlled airflow resistance. An electrically conducting body 43, eg of metal, is inserted through an opening in the microphone housing bottom wall 41, which body 43 is made so that it will be in electrical contact with the back side of the back plate electrode 17 when the parts are properly assembled. This allows the electrical signal to be transmitted from the back plate electrode 17 through the microphone housing insulating bottom wall 41. Also the bottom wall 41 determines the volume of the back chamber together with the internal cavity piece 31. The ring-shaped member 12, with diaphragm 11 and back plate electrode 17, the volume piece 31 and the microphone housing bottom wall 41 are held in place in the microphone housing using a ring shaped body 51. This can for example be made with a thread fitting or as a spring as shown in FIG. 2. The exact realisation of the ring shaped body has little importance for the performance of the microphone and is not shown in detail.

Figure 5A:
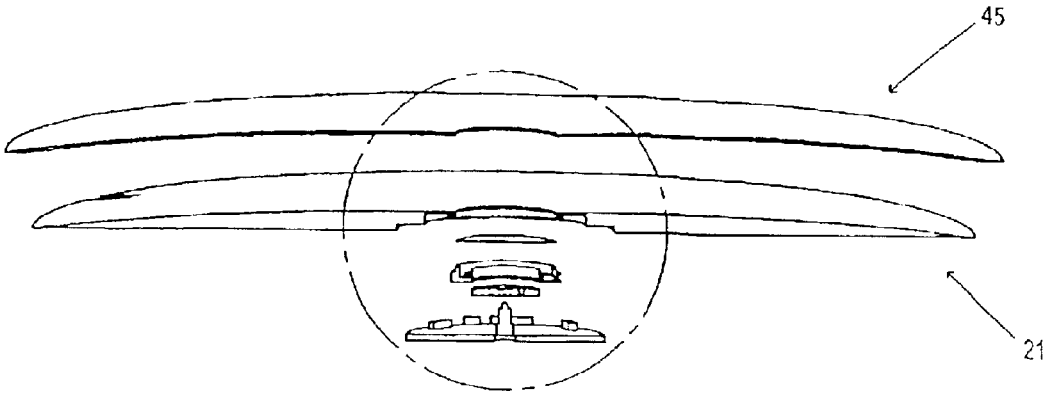
FIGS. 5*a* and 5*b* show another use of the capacitive transducer of the invention in a condenser microphone.
Figure 5B:
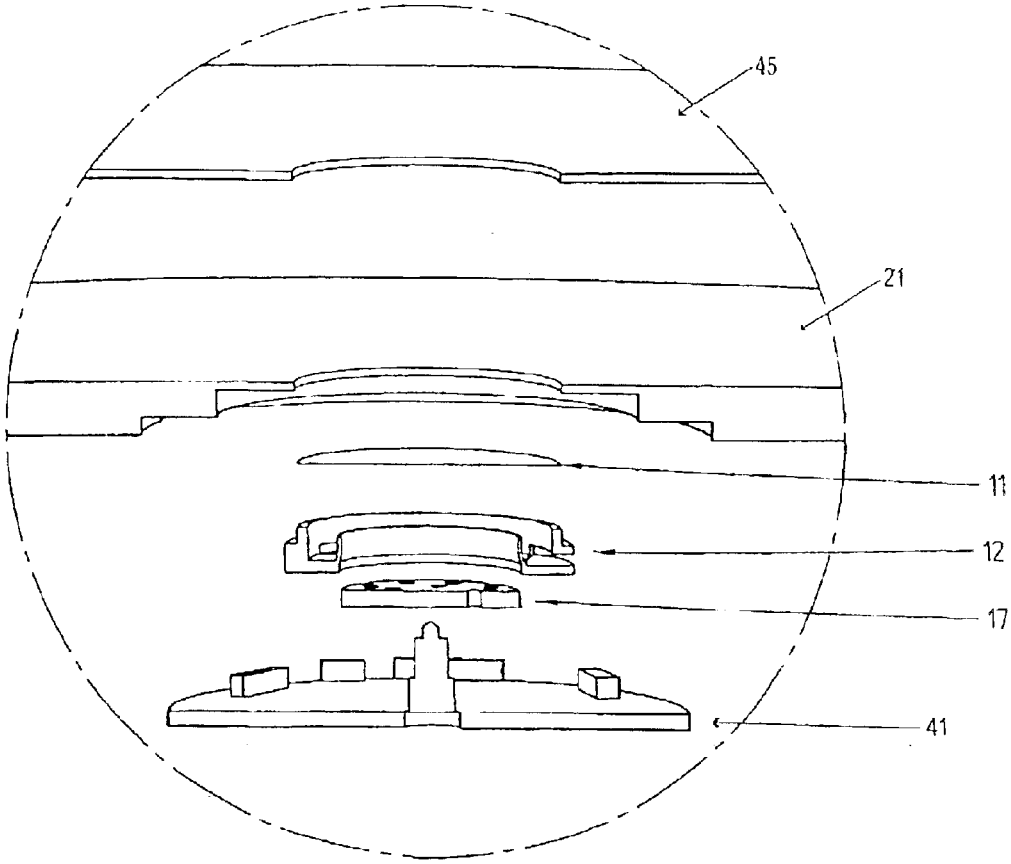

FIGS. 5*a* and 5*b* show another condenser microphone using the capacitive transducer according to the invention. FIG. 5*a* shows a full view and FIG. 5*b* shows a close-up of the central part of the microphone in FIG. 5*a*.

The condenser microphone illustrated in FIGS. 5*a* and 5*b* makes use of the possibility of inserting the transducer 1 shown in FIG. 3A into a microphone housing with a shape differing from any previous measurement microphones without compromising overall requirements with respect to stability and environmental sensitivity. Like in the embodiment in FIG. 2, the transducer 1 is inserted into a microphone housing 21. The microphone housing 21, however, is shaped so that the overall height is reduced to a minimum determined mainly by the thickness of the back plate electrode 17 and the ring-shaped member 12. A protecting cover 45 may be used to protect in particular the diaphragm 11. By increasing or decreasing the inner diameter and/or the length of the housing the size of the back chamber volume in the microphone can be adjusted. The bottom wall 41 of the microphone housing is made with the same overall considerations as before, only in this embodiment the diameter of the bottom wall 41 is larger than the diaphragm 11.

For use in this embodiment the ring-shaped member 12 has one or more radially extending openings in the outer cylindrical wall near the bottom wall 13. When the microphone is assembled a closed volume behind the diaphragm will include a volume externally to the ring-shaped member 12, where the housing 21 and the bottom wall 41 delimit the volume.

Compared to the prior art this embodiment is made possible because the ring-shaped member 12 can be scaled to a smaller size in both axial and radial directions, and the radially extending openings give access to a volume of air externally to the ring-shaped member 12. The presented embodiment will have a significant impact in areas where physical dimensions only allow the use of a very thin transducer, and where it is necessary to measure with the same high accuracy and stability as in normal measurement microphones.

FIGS. 3 and 3A show that the surface 14 is recessed relative to the surface 15 carrying the diaphragm 11. When the capacitive transducer of FIG. 3A in the cylindrical microphone housing 21 of FIG. 2 or in the large-diameter plate-shaped housing 21 of FIGS. 5B and 5A with the reference plane 14 abutting the corresponding reference plane 23 of the respective microphone housings, the diaphragm 11 will be flush with the front end of the microphone housing, whereby in particular no cavity is formed with the diaphragm forming the bottom of the cavity. Such a cavity is undesirable, since it will inevitably influence the acoustic performance of the microphone.

However, a diaphragm which is flush with the front end of the microphone housing is vulnerable, and it may therefore be desirable to have the diaphragm recessed a fraction of a mm, say 20–100 $\mu$m, relative to the front end of the microphone housing. This is easily obtained by proper dimensioning of the height of the upstanding wall 15 carrying the diaphragm and the thickness of the inwardly extending flange with the reference plane 23 of the microphone housing.

A special version of the condenser microphone is the prepolarised microphone, also known as an electret microphone. A microphone of this type has a pre-polarised material, which stores a permanent electrical charge providing the electrical field necessary for the operation of the microphone. The pre-polarised material is an insulating material, usually thin sheet of a plastics material. In the invention the pre-polarised material will be placed either on the stationary electrode or back plate electrode 17 before this is mounted in the ring-shaped member 12.

A system comprising a microphone similar to the one in FIG. 2, a preamplifier and possibly other electronics may be easily composed.

Some preferred embodiments have been shown in the foregoing, but it should be stressed that the invention is not limited to these, but may be embodied in other ways within the subject matter defined in the following claims. For example, instead of planar electrodes and back plate electrode as illustrated in the figures, these parts may have any convenient shape such as hyperbolic, parabolic, dome, or they may have a contour comprising steps or bends.

What is claimed is:

1. A capacitive transducer, comprising:

a ring-shaped member defining an axis, the ring-shaped member having an outer annular wall and an inner annular wall rigidly connected to the outer annular wall, the inner annular wall having an opening;

a diaphragm secured to the outer annular wall of the ring-shaped member and overlaying the opening, the diaphragm having an outer periphery and an electrically conductive portion, the diaphragm and the electrically conductive portion being movable in response to sound pressure; and a disc-shaped member secured in the opening of the inner annular wall and in parallel relationship to the diaphragm, the disc-shaped member having a first side with a first electrically conductive surface portion, and a second side opposite the first side, the second side having a second electrically conductive surface portion in electrical contact with the first electrically conductive surface portion, the first electrically conductive surface portion being spaced from the ring-shaped member and facing the diaphragm in a predetermined distance therefrom, whereby the diaphragm and the first electrically conductive surface portion form an electrical capacitor, wherein the second electrically conductive surface portion is directly accessible.

2. The transducer according to claim 1, wherein the ring-shaped member has, outside the outer periphery of the diaphragm, a free surface extending transversally to the axis of the ring-shaped member.

3. The capacitive transducer, comprising:

a ring-shaped member with an opening defining an axis;

a diaphragm secured to the ring-shaped member and overlaying the opening, the diaphragm having an outer periphery and an electrically conductive portion, the diaphragm and the electrically conductive portion being movable in response to sound pressure; and a disc-shaped member secured in the opening of the ring-shaped member and in parallel relationship to the diaphragm, the disc-shaped member having a first side with an electrically conductive portion, and a second side opposite the first side, the second side having a contact member in electrical contact with the electrically conductive portion on the first side of the disc-shaped member, the electrically conductive portion on the first side of the disc-shaped member being spaced from the ring-shaped member and facing the diaphragm in a predetermined distance therefrom, whereby the diaphragm and the electrically conductive portion, on the disc-shaped member form an electrical capacitor, wherein the ring-shaped member has, outside the outer periphery of the diaphragm, a free surface extending transversally to the axis of the ring-shaped member.

4. The transducer according to claim 3, wherein the second side of the disc-shaped member and the contact member are directly accessible.

5. The transducer according to claim 1, wherein the transducer comprises a housing, which together with the diaphragm defines a substantially closed volume, and that the housing has an externally accessible electrical connection to the electrically conductive portion on the disc-shaped member.

6. The transducer according to claim 5, wherein the substantially closed volume extends through one or more radially extending openings in the ring-shaped member.

7. The transducer according to claim 1, wherein the ring-shaped member is made of an electrically conducting material.

8. The transducer according to claim 1, wherein the disc-shaped member is retained in the ring-shaped member by frictional forces.

9. The transducer according to claim 1, wherein the disc-shaped member comprises an electrically insulating material carrying the electrically conductive portion, the electrically insulating material being chosen from the group of materials consisting of ceramic materials, plastics, ruby, sapphire and quartz.

10. The transducer according to claim 1, wherein the electrically insulating material is $Al_2O_3$.

11. The transducer according to claim 1, wherein an electrically prepolarised material at least partially covers the first side of the disc-shaped member or the side of the diaphragm facing the disc-shaped member or both.

12. The transducer according to claim 3, wherein the free surface extending transversally to the axis of the ring-shaped member is recessed relative to the diaphragm.

13. The transducer according to claim 12, wherein the transducer comprises a ring-shaped or tubular member with a first surface in abutment against the free surface of the ring-shaped member and with a front surface parallel to the diaphragm and opposite the first surface, and with the diaphragm recessed between 20 $\mu$m and 100 $\mu$m relative to the front surface.

14. The transducer according to claim 12, wherein the transducer comprises a ring-shaped or tubular member with a first surface in abutment against the free surface of the ring-shaped member and with a front surface parallel to the diaphragm and opposite the first surface, and with the diaphragm substantially flush with the front surface.

* * * * *